US006648570B2

(12) United States Patent
Munn

(10) Patent No.: US 6,648,570 B2
(45) Date of Patent: Nov. 18, 2003

(54) LIFTING AND INSTALLING STREETLIGHT POLES

(75) Inventor: David J. Munn, Raleigh, NC (US)

(73) Assignee: Progress Energy Carolinas, Inc., Raleigh, NC (US)

( * ) Notice: Subject to any disclaimer, the term of this patent is extended or adjusted under 35 U.S.C. 154(b) by 0 days.

(21) Appl. No.: 09/883,117

(22) Filed: Jun. 15, 2001

(65) Prior Publication Data

US 2002/0192054 A1 Dec. 19, 2002

(51) Int. Cl.[7] ..... B66F 11/00

(52) U.S. Cl. ..... 414/23; 294/74; 294/82.11; 294/82.14

(58) Field of Search ..... 414/23; 294/74, 294/82.11, 82.14

(56) References Cited

U.S. PATENT DOCUMENTS

| | | | | |
|---|---|---|---|---|
| 112,214 A | | 2/1871 | Brewer | |
| 609,417 A | | 8/1898 | Day | |
| 1,871,603 A | | 8/1932 | Gintor | |
| 1,908,146 A | | 5/1933 | Helton | |
| 2,249,907 A | | 7/1941 | Perkowski | |
| 2,443,307 A | | 6/1948 | De Cuir | |
| 3,103,344 A | * | 9/1963 | Figge | 24/135 N |
| 3,352,433 A | | 11/1967 | Moore | |
| 3,631,991 A | * | 1/1972 | Wacht et al. | 212/231 |
| 4,856,836 A | * | 8/1989 | Delphin | 294/74 |
| 5,277,463 A | * | 1/1994 | Singh et al. | 294/103.1 |
| 6,032,907 A | * | 3/2000 | Santa Cruz et al. | 174/135 |

FOREIGN PATENT DOCUMENTS

| | | | | |
|---|---|---|---|---|
| JP | 1-271393 | | 10/1989 | |
| SU | 734369 | | 5/1980 | |
| SU | 937312 | | 6/1982 | |
| SU | 1178676 | | 9/1985 | |
| SU | 1178-676 | * | 9/1985 | B66C/1/12 |

* cited by examiner

*Primary Examiner*—Eileen D. Lillis
*Assistant Examiner*—Michael Lowe
(74) *Attorney, Agent, or Firm*—Richard S. Faust

(57) ABSTRACT

Streetlight poles are lifted to a vertical position for installation in a mounting hole or on a support stand by connecting the lift cable of a boom to an elongate sling that is releasably attached to the pole.

19 Claims, 4 Drawing Sheets

LIFTING AND INSTALLING STREETLIGHT POLES

FIELD OF THE INVENTION

The invention relates to the installation of streetlight poles. More particularly, the invention relates to procedures and apparatus for lifting streetlight poles to a vertical position so that the poles may be installed in a mounting hole or on a support stand.

BACKGROUND OF THE INVENTION

Streetlight poles are made of various materials such as steel, fiberglass, concrete and wood. These poles may range in height from about 20 to 45 feet, or more, and usually taper somewhat from a higher diameter base to a smaller diameter top. The poles typically weigh about 600 to 800 pounds, or more. During the installation of a streetlight pole the pole must be raised to a vertical position, with the lower end of the pole residing at the mounting hole or support stand where it will be located. Numerous issues, not all apparent to the uninitiated, must be addressed in order to raise a streetlight pole in a safe and efficient manner.

One initial issue is that the pole preferably should be raised without utilizing external eyes, lugs, pins, or the like, that are physically attached to the pole. Such attachments are undesirable because of potential interference with the structural integrity of the pole and due to aesthetic considerations.

Streetlight poles also should be raised without the use of support dollies, or the like, that move on the ground. Dollies used for this purpose are problematical due to the uneven terrain often encountered at installation sites and the inconvenience and expense of transporting the dollies.

It is, of course, desirable that the apparatus and method employed to raise a streetlight pole have the capability of raising the pole to a fully vertical position, unlike certain procedures that are unable to do so.

Additionally, it is desirable that when a boom is used to raise the streetlight poles, which is the procedure most often employed, the boom should be operable with minimum vertical clearance. Significant clearance is not always available at the installation site, and working at unnecessary height increases safety concerns.

It is also desirable that any pole lifting and installation operation, and the straps, slings and other apparatus used therein, be universal in their application; i.e., the operation and apparatus should work without substantial modification on a wide range of streetlight pole lengths.

As a significant safety concern, it is desirable that as the pole reaches a vertical orientation, the bottom of the pole should be easily maneuverable by working personnel for positioning in the mounting hole or on the support stand. A procedure that creates a hazardous and/or unwieldy situation is to be avoided at all costs, for example, the hazardous situation where the bottom end of the pole may suddenly break away from ground contact, resulting in a swinging pole that can injure working personnel as it swings or when it once again comes to rest on the ground. Also to be avoided is a situation where the means of attachment of the lifting device to the pole, for example a strap wrapped around the pole using a half-hitch rigging method, slips along the length of the pole, resulting in a dangerous drop in the pole and potential injury to working personnel. This slipping situation is particularly problematic when the streetlight pole has a polished metal or fiberglass surface, and is even more likely when the light fixture(s) is mounted at the top of the pole before lifting, which is usually the case.

Lastly, current streetlight lifting and installation operations often require excessive manpower and simply take too long. For example, the most prevalent current operations that utilize a strap wrapped around the pole with a half-hitch rigging require that a lineman get into a bucket or use a fiberglass stick to remove the strap, an operation that adds five to ten minutes to each operation.

Thus, there is an acute need for a reliable, safe and time-saving method and apparatus for lifting and installing streetlight poles that overcomes the various problems stated above.

SUMMARY OF THE INVENTION

The present invention provides an operational procedure and apparatus that safely and quickly raises streetlight poles for installation, while overcoming the problems set forth above.

In one aspect, the invention may be defined as a method utilizing a boom and associated lifting cable, in conjunction with working personnel on the ground, to raise a streetlight pole to a substantially vertical position, and to install the streetlight pole in a mounting hole or on a support stand. The method is carried out by releasably attaching one end of an elongate sling at a point toward the bottom of a streetlight pole, with a portion of the sling proximate the other end thereof being wrapped around the pole at a point above the balance point of the pole. The wrapped-around portion of the sling is releasably attached to the lifting cable. A lifting force is applied via the lifting cable to raise the upper end of the pole off the ground while the lower end of the pole continues to rest on the ground. Upon continued application of the lifting force there is no slippage of the wrapped-around portion of the sling with respect to the pole.

Eventually the pole nears or reaches vertical orientation and the bottom of the pole lifts off the ground, thereby permitting working personnel on the ground to maneuver the lower end of the pole to the mounting hole or support stand.

In another aspect, the invention may be defined as a streetlight pole and releasably attached elongate sling for use, in conjunction with a lifting device, to raise the streetlight pole to a substantially vertical position where working personnel on the ground can safely and efficiently maneuver the lower end of the pole to a mounting hole or support stand. The sling has first and second ends and a length sufficient to span from an attachment point toward the bottom of the pole to a point above the balance point of the pole. The first end of the sling is wrapped around the pole above the balance point of the pole for connecting to a lifting device. Cooperative attachment structures located toward the bottom of the pole and at the second end of the sling releasably attach the second end of the sling to the pole, whereby upon application of a lifting force by the lifting device slack may be eliminated in the length of the sling between the sling first and second ends to prevent slippage of the sling with respect to the pole and to permit raising of the pole to a vertical position where the working personnel on the ground can safely and efficiently maneuver the lower end of the pole to a mounting hole or support stand. The cooperative attachment structures may take the form of an access opening in the pole toward the lower end of the pole and a hook located at the second end of the sling. The sling may include a loop portion at the sling first end connected to a strap portion that extends from the loop portion to the sling second end.

BRIEF DESCRIPTION OF THE DRAWINGS

Some of the objects having been stated, other objects will appear as the description proceeds, when taken in connection with the accompanying drawings, in which—

DETAILED DESCRIPTION OF THE INVENTION

While the present invention will be described more fully hereinafter with reference to the accompanying drawings, in which aspects of the preferred manner of practicing the present invention are shown, it is to be understood at the outset of the description which follows that persons of skill in the appropriate arts may modify the invention herein described while still achieving the favorable results of this invention. Accordingly, the description which follows is to be understood as being a broad, teaching disclosure directed to persons of skill in the appropriate arts, and not as limiting upon the present invention.

Figure 1:
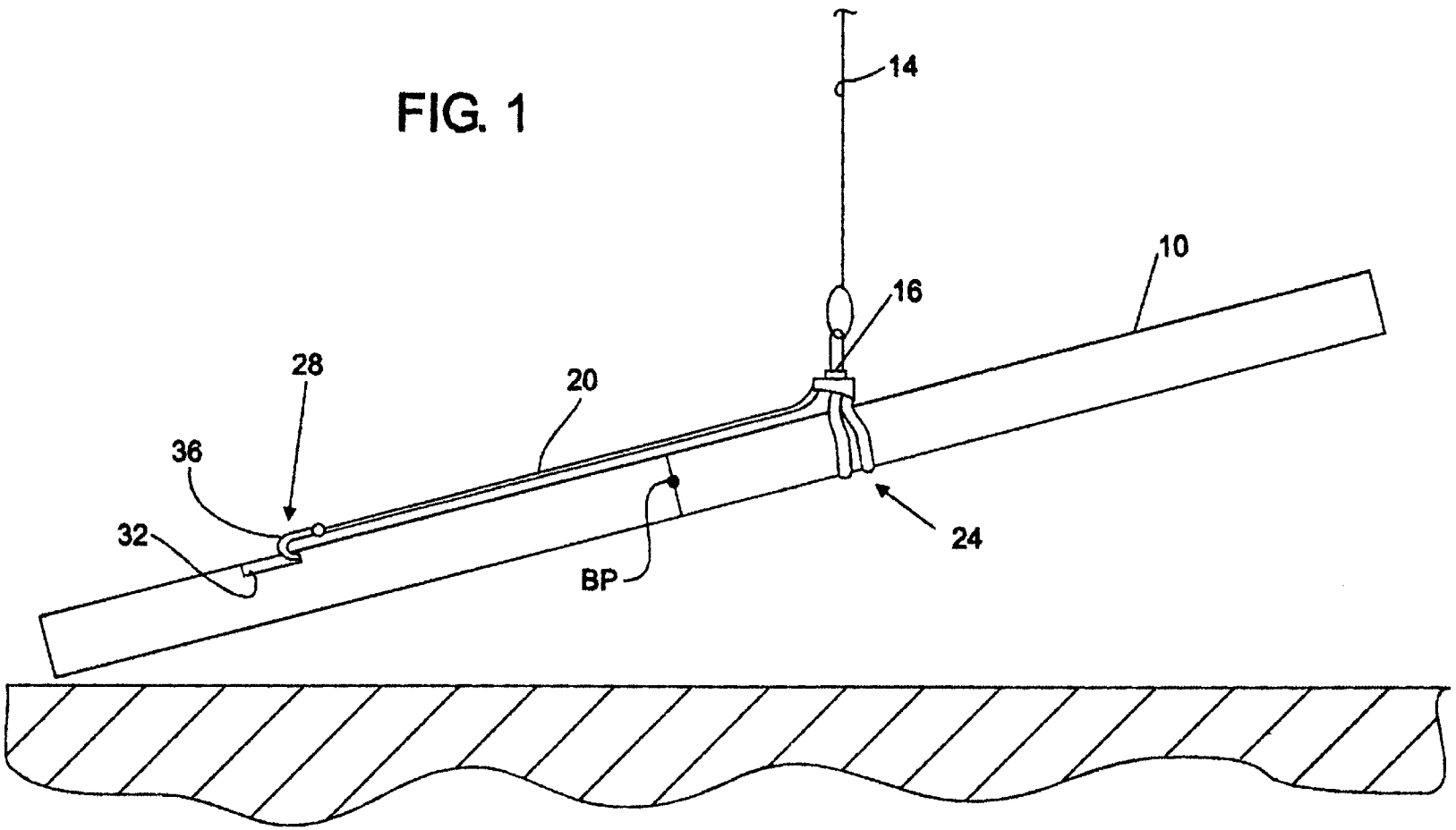
FIG. 1 is a view of a streetlight pole after it has been partially raised and illustrating the lifting cable and attached buckle or shackle from a lifting boom (not shown) and the elongate sling that enables attachment of the lifting cable/shackle to the pole.

Referring to the drawings, and particularly to FIG. 1, there is shown a streetlight pole 10 made of steel, fiberglass or concrete with a relatively smooth surface that tapers somewhat from a larger diameter base or bottom to a smaller diameter top. The pole has a height from 20 to 45 feet or more, and a weight from about 600 to 800 pounds or more.

Pole 10 is at an installation site where the pole must be lifted to a vertical position in such a way that working personnel on the ground can safely and efficiently maneuver the lower end of the pole into a mounting hole or onto a support stand.

The lifting force for raising pole 10 is accomplished utilizing a lifting device, preferably a conventional boom (shown in FIG. 4 only) having a lifting cable 14 and associated attachment means such as a shackle 16.

An elongate sling 20 is releasably attached to pole 10 and to shackle 16 in the manner described below in order to lift the pole to a vertical position in a safe and efficient manner that avoids the pitfalls described above. Sling 20 has a first end 24 and a second end 28, and an overall length sufficient to span from a point toward the bottom of the pole to a point above the balance point BP of the pole. A portion of the sling at first end 24 is wrapped around the pole at a point above the balance point of the pole where it is releasably attached to shackle 16. Sling 20 extends therefrom down the length of pole 10 to sling second end 28 that releasably attaches toward the lower end of the pole by cooperative attachment structures located at the second end of the sling and on the pole. In the illustrated embodiment, the cooperative attachment structures take the form of an opening in the pole, for example, a conventional pole access opening 32, and a hook 36 attached at the second end of the sling. Upon initial application of lifting force via the boom through lifting cable 14 and shackle 16, slack is eliminated in the length of sling between the sling first and second ends and the upper end of the pole raises off the ground while the lower end of the pole continues to rest on the ground. In this regard, unlike certain techniques of the prior art, once the sling is taut, the slippage of the wrapped-around portion of the sling at the point of attachment to the lifting device is eliminated, thereby preventing hazardous shifts in the point of lifting attachment and resultant unsafe movements in the pole. As the lifting force continues, the pole reaches a vertical orientation and the bottom of the pole lifts off the ground, thereby permitting working personnel on the ground to maneuver the lower end of the pole to the mounting hole or support stand.

Figure 2:
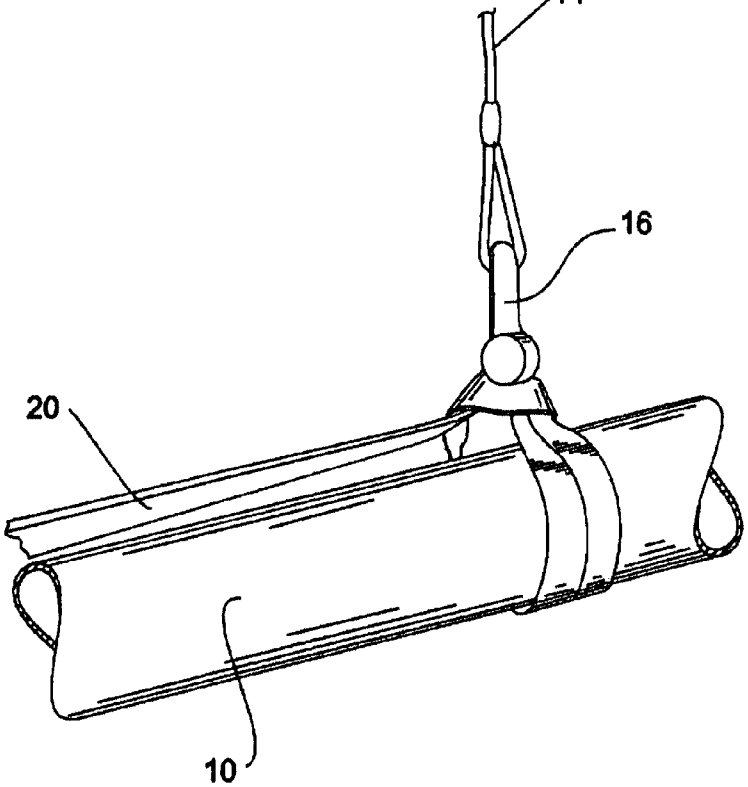
FIG. 2 is an enlarged view of the upper point of attachment of the sling to the streetlight pole, at a point above the balance point of the pole.
Figure 3:
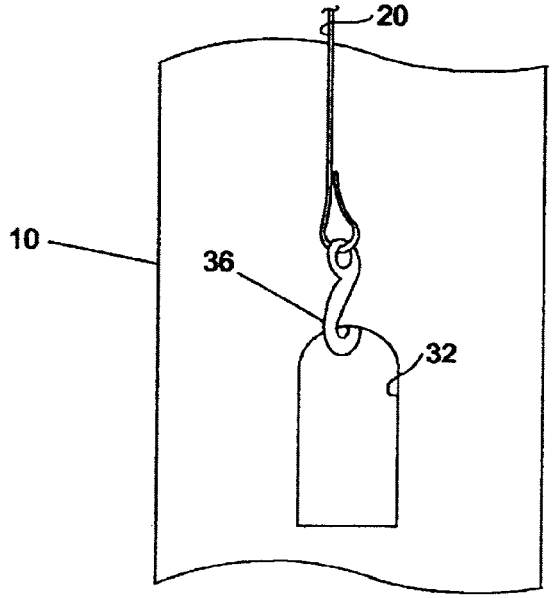
FIG. 3 is an enlarged view of the lower point of attachment of the sling to the streetlight pole, at a point toward the bottom of the pole.

FIG. 2 is an enlarged view of the upper point of attachment of the sling to the streetlight pole, while FIG. 3 is an enlarged view of the lower point of attachment.

Figure 4:
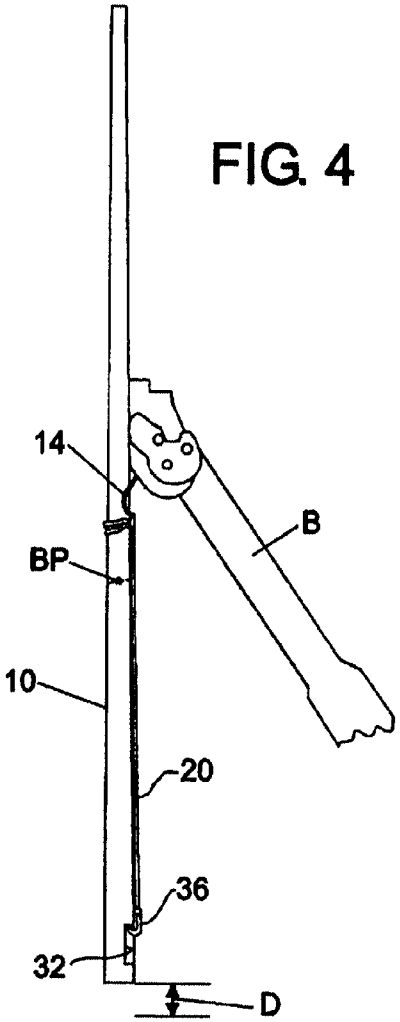
FIG. 4 shows the pole lifted to a vertical position where the bottom of the pole is safely maneuverable by working personnel.

FIG. 4 shows the pole lifted by boom B to a vertical position where it can be safely maneuvered by working personnel (not shown). In this regard, as pole 10 nears or reaches vertical orientation, the bottom of the pole lifts clear of the ground, for example, by a distance D, so that working personnel can manually engage the pole and move the pole bottom to the mounting hole or support stand. The lifting method and apparatus of the invention assures that the bottom of the pole will lift off the ground without any sudden breaking away and swinging of the pole. Also, it is at this point in the operation that it is most critical that there be no vertical slippage of the pole with respect to the sling since the working personnel are now in close proximity to the pole. It will be appreciated that the taut portion of the sling between the two points of attachment prevents slippage.

Figure 5:
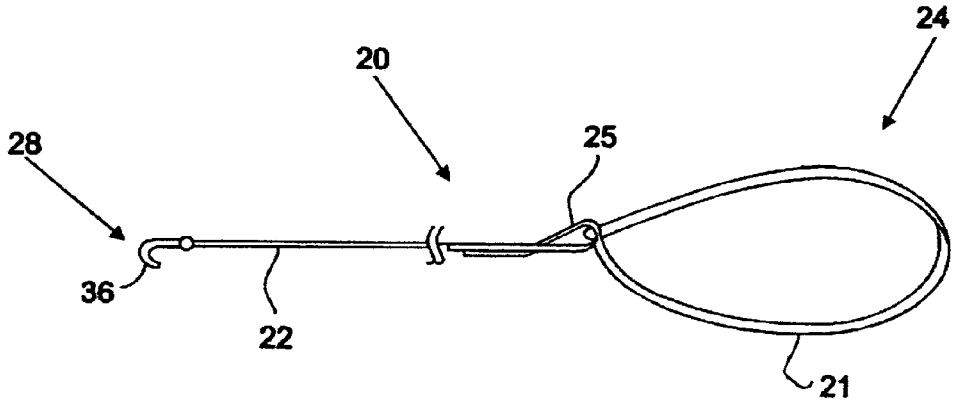
FIG. 5 is a view of one preferred sling of the invention.

FIG. 5 is a view of one preferred form of sling 20.

In this embodiment, sling 20 is formed of nylon web material and includes a loop portion 21 having a lay-flat length of about five feet that is connected to a strap portion 22 having a length of about fifteen feet. The strap portion terminates at its free end in attachment hook 36. The connection of loop portion 21 to strap portion 22 may be achieved by any suitable means. In the illustrated embodiment this connection is achieved by capturing the loop portion within an eye 25 formed at the end of strap portion 22. The strap portion is formed of material having a suitable load carrying ability, and in the illustrated embodiment the strap is formed from one inch wide nylon web material rated at 3000 pounds.

Loop portion 21 is formed of the same or similar material, but with a two inch width.

It has been found that the above dimensions for the sling provides a sling with universal applicability to 25, 30 or 35 foot fiberglass streetlight poles, and to 25, 26, 30, 35 and 39 foot metal streetlight poles, using the standard access openings at the lower ends of the poles and with the upper point of sling attachment positioned, as is necessary, above the pole balance points (BP). In this regard, the sling of FIG. 5 provides a preferred distance of about fifteen to seventeen feet between where the sling wraps around the pole and where it attaches to the access opening, with a distance in the range of fourteen to eighteen feet being a workable distance for most applications of the invention.

Figure 6A:
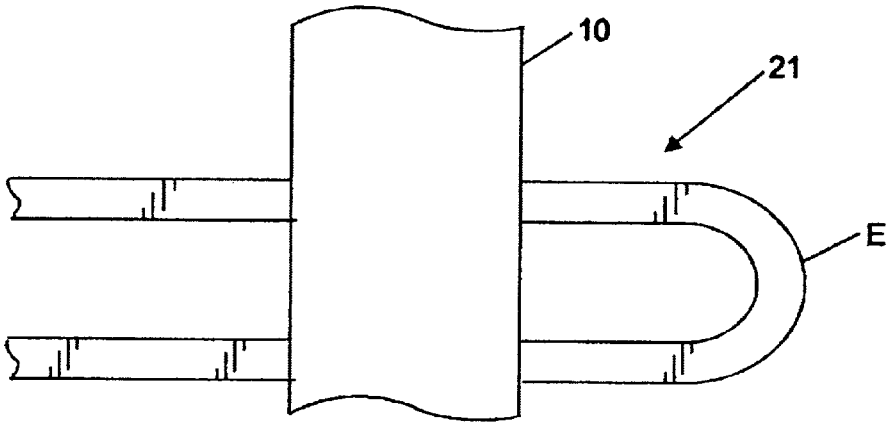
FIGS. 6A and 6B show how the loop portion of the sling of FIG. 5 wraps around the pole and attaches to the lifting device.
Figure 6B:
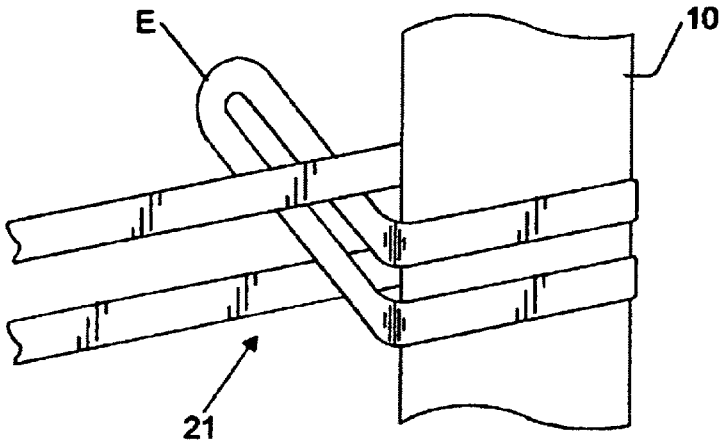

The preferred manner of wrapping the first end of sling 20 around pole 10 is shown in FIGS. 6A and 6B. First, loop portion 21 is placed under the pole (FIG. 6A) after which end E of the loop is brought around the pole and then inserted back through the main part of the loop (FIG. 6B). End E is then connected to buckle or shackle 16 as discussed above. Once a lifting force is applied by the boom through lifting cable 14, the portion of the sling between the two points of attachment becomes taut as slack is removed, and loop portion 21 engages pole 10 as shown in FIG. 2.

For convenience, the poles that are lifted and installed according to the present invention have been referred to as "streetlight poles". It will be appreciated that this term is deemed to encompass not only poles located on streets and roadways but also poles used for area lighting, for example, the lighting of parking lots, commercial real estate, or the like. It will also be appreciated that, while not shown in the drawings, when the streetlight poles are raised they usually will already have a light fixture attached at the top of the pole.

While the present invention has been described in connection with certain illustrated embodiments, it will be appreciated that modifications may be made without departing from the true spirit and scope of the invention.

That which is claimed is:

1. A method utilizing a boom and associated lifting cable, in conjunction with working personnel on the ground, to raise a streetlight pole to a substantially vertical position, and to install the streetlight pole in a mounting hole or on a support stand, said method comprising the steps of:

providing a boom and associated lifting cable;

releasably attaching one end of an elongate sling at a point toward the bottom of a streetlight pole, with a portion of the sling proximate the other end thereof being wrapped around the pole at a point above the balance point of the pole;

the wrapped-around portion of the sling comprising a loop portion, and wherein the step of wrapping the sling around the pole at a point above the balance point of the pole comprises bringing an end (E) of the loop portion around the pole and then through the main portion of the loop;

releasably attaching the wrapped-around portion of the sling to the lifting cable;

beginning to apply a lifting force via the lifting cable to raise the upper end of the pole off the ground while the lower end of the pole continues to rest on the ground; and continuing to apply a lifting force via the lifting cable without substantial slippage of the wrapped-around portion of the sling with respect to the pole until the pole nears or reaches vertical orientation and the bottom of the pole lifts off the ground, thereby permitting working personnel on the ground to maneuver the lower end of the pole to the mounting hole or support stand.

2. The method of claim 1 wherein the step of releasably attaching one end of the sling at a point toward the bottom of the pole comprises positioning a hook at the sling end into an opening in the pole.

3. The method of claim 1 wherein the step of releasably attaching the wrapped-around portion of the sling to the lifting cable comprises attaching end (E) of the loop portion to the lifting cable.

4. The method of claim 1 wherein the step of beginning to apply a lifting force via the lifting cable serves to remove slack in the sling between the two ends thereof.

5. A streetlight pole and releasably attached elongate sun for use, in conjunction with a lifting device, to raise the streetlight pole to a substantially vertical position where working personnel on the ground can safely and efficiently maneuver the lower end of the pole to a mounting hole or support stand, said sling having first and second ends and a length sufficient to span from an attachment point toward the bottom of the pole to a point above the balance point of the pole, the first end of the sling comprising a loop portion that is wrapped around the pole and then through itself at a point above the balance point of the pole for connecting to a lifting device, cooperative attachment structures located toward the bottom of the pole and at the second end of the sling releasably attaching the second end of the sling to the pole, whereby upon application of a lifting force by the lifting device slack may be eliminated in the length of the sling between the sling first and second ends to prevent slippage of the sling with respect to the pole and to permit raising of the pole to a vertical position where the working personnel on the ground can safely and efficiently maneuver the lower end of the pole to a mounting hole or support stand.

6. The combination of claim 5 wherein the cooperative attachment structures comprise an access opening in the pole toward the lower end of the pole and a hook located at the second end of the sling.

7. The combination of claim 5 wherein the sling first end loop portion is a discrete loop that connects to a strap portion that extends from the loop portion to the sling second end.

8. The combination of claim 7 wherein said sling loop portion releasably connects to a lifting device which is in the form of a boom and depending lift cable.

9. The combination of claim 7 wherein the distance between where the sling first end wraps around the pole and the sling second end releasably attaches to the pole is on the order of thirteen to eighteen feet.

10. The combination of claim 9 wherein the sling has universal applicability to multiple fiberglass and metal streetlight poles in the range from about twenty five to thirty nine feet in length using the standard access openings near the lower ends of the poles.

11. The combination of claim 7 wherein said sling loop portion has a lay-flat loop length of about five feet and said strap portion has a length of about fifteen feet.

12. The combination of claim 11 wherein the sling has universal applicability to multiple fiberglass and metal streetlight poles in the range from about twenty five to thirty nine feet in length using the standard access openings near the lower ends of the poles.

13. An elongate sling for use, in conjunction with a lifting device, to raise a streetlight pole to a substantially vertical position where working personnel on the ground can safely and efficiently maneuver the lower end of the pole to a mounting hole or support stand, said sling having first and second ends and a length sufficient to span from an attachment point toward the bottom of the pole to a point above the balance point of the pole, the first end of the sling having a loop portion for wrapping around a streetlight pole above the balance point of the pole and for connecting to a lifting device, and said sling further including an attachment structure at the second end of the sling for releasably attaching the second end of the sling to a cooperative attachment structure located toward the bottom of the pole, whereby upon application of a lifting force by the lifting device to the sling loop portion slack may be eliminated in the length of the sling between the sling first and second ends to prevent slippage of the sling with respect to the pole and to permit raising of the pole to a vertical position where the working personnel on the ground can safely and efficiently maneuver the lower end of the pole to a mounting hole or support stand.

14. The elongate sling of claim 13 wherein the cooperative attachment structure on the pole comprises an access opening toward the lower end of the pole and the sling attachment structure comprises a hook located at the second end of the sling.

15. The elongate sling of claim 13 wherein said sling loop portion connects to a strap portion that extends from the loop portion to the sling second end.

16. The elongate sling of claim 15 wherein the distance between where the sling first end wraps around the pole and the sling second end releasably attaches to the pole is on the order of thirteen to eighteen feet.

17. The elongate sling of claim 16 wherein the sling has universal applicability to multiple fiberglass and metal streetlight poles in the range from about twenty five to thirty nine feet in length using the standard access openings near the lower ends of the poles.

18. The elongate sling of claim 15 wherein said sling loop portion has a lay-flat loop length of about five feet and said strap portion has a length of about fifteen feet.

19. The elongate sling of claim 18 wherein the sling has universal applicability to multiple fiberglass and metal streetlight poles in the range from about twenty five to thirty nine feet in length using the standard access openings near the lower ends of the poles.

* * * * *